US005287819A

United States Patent [19]

Beatty et al.

[11] Patent Number: 5,287,819

[45] Date of Patent: Feb. 22, 1994

[54] HIGH SPEED DYNAMICALLY BALANCED TUFTING MACHINE

[75] Inventors: Paul Beatty, Chattanooga; Marshall A. Neely, Soddy-Daisy, both of Tenn.

[73] Assignee: Card-Monroe Corp., Chattanooga, Tenn.

[21] Appl. No.: 991,103

[22] Filed: Dec. 16, 1992

[51] Int. Cl.[5] ..... D05B 15/04; D05B 15/20; D05B 69/02

[52] U.S. Cl. ..... 112/80.01; 112/221; 112/80.4

[58] Field of Search ..... 112/80.01, 80.4, 221, 112/266.2; 74/44, 603, 604; 123/192.1, 192.2, 52 A, 53 AA, 53 BA, 51 AA, 51 BA, 56 AC, 56 BC; 28/113, 114

[56] References Cited

U.S. PATENT DOCUMENTS

| | | | |
|---|---|---|---|
| 4,665,845 | 5/1987 | Card et al. | 112/80.4 |
| 4,669,403 | 5/1987 | Bagnail | 112/80.4 |
| 4,936,268 | 6/1990 | Randle | 74/603 X |

*Primary Examiner*—Peter Nerbun
*Assistant Examiner*—Paul C. Lewis
*Attorney, Agent, or Firm*—Hopkins & Thomas

[57] ABSTRACT

A tufting machine having individual crank assemblies for reciprocating the push rods which carry the needle bar. Successive crank shafts aligned with each other and parallel to two main drive shafts which are rotated in opposite directions. Gears on the main drive shafts respectively transfer power from the two drive shafts so as to rotate each successive crank shaft in a direction opposite from the direction of rotation of the preceding crank shaft. The connecting rods connected to the crank assemblies thus are thrown outwardly in opposite directions as the crank shafts are rotated, so as to balance the machine. Additional counter-balance weights are provided on the main drive shafts.

23 Claims, 3 Drawing Sheets

HIGH SPEED DYNAMICALLY BALANCED TUFTING MACHINE

BRIEF SUMMARY OF THE INVENTION

This invention relates to tufting machines and is more particularly concerned with a high speed dynamically balanced tufting machine.

In the past, there have been continuous effort to increase the production capacity of tufting machines by increasing the speed of operation of the machine. At the present time, using the structure of U.S. Pat. No. 4,665,845, tufting machines can be produced which will obtain a speed of 1,320 rpm and perhaps higher.

The present invention, by providing an improved needle bar reciprocating mechanism will increase the speed of these high speed tufting machines even more while, at the same time, reducing the vibration of the machine. Thus, the present dynamically balanced tufting machine can provide speeds in the neighborhood of 2,000 rpm and higher.

Briefly described, the present invention includes a conventional multineedle tufting machine in which there are two spaced, transversely extending, drive shafts, disposed within the head, these drive shafts extending parallel to each other throughout the head of the machine. One of these drive shafts is driven by the main motor so that it rotates in one direction while the other drive shaft is belt driven from the main shaft so as to rotate in the opposition direction. Timing belts driven from the one drive shaft, drive alternate odd needle stroke assemblies or modules in one direction of rotation while timing belts from the second drive shaft drive the even needle stroke assemblies in an opposition direction. By rotating the drive shafts in opposite directions, the connecting rods, which reciprocate the push rods of the needle bar, are moved in clockwise and counter-clockwise directions, simultaneously, whereby the weight of these connecting rods counter-balance each other, in cooperation with the weights mounted on the two drive shafts themselves.

Accordingly, it is an object of the present invention to provide a tufting machine which is inexpensive to manufacture, durable in structure and efficient in operation.

Another object of the present invention is to provide a tufting machine which will operate at extremely high speeds.

Another object of the present invention is to provide a tufting machine which can accelerate to operating speed rapidly and without appreciable overload on the motor.

Another object of the present invention is to provide a tufting machine which has a needle bar drive mechanism which is well balanced and which reduces the vibration and friction generated by the tufting machine when operating at a high speed.

Another object of the present invention is to provide, in a tufting machine, a needle bar drive mechanism which will reduce to a minimum the imbalance of the parts of the needle bar reciprocating mechanism.

Another object of the present invention is to provide a tufting machine in which the overdrive of the needles which are driven at high speed will be reduced to a minimum.

Another object of the present invention is to provide a tufting machine in which the worn parts of the needle bar reciprocating mechanism can be readily and easily replaced and in which the driving and timing mechanism can be readily regulated.

Another object of the present invention is to provide a tufting machine which will operate at extremely high speed with little vibration and will accelerate and decelerate without excessive vibration.

Another object of the present invention is to provide a tufting machine which generates less noise and heat than the conventional tufting machine.

Other objects, features and advantages of the present invention will become apparent from the following description when considered in conjunction with the accompanying drawings wherein like characters of reference designate corresponding parts throughout the several views.

DETAILED DESCRIPTION

Figure 1:
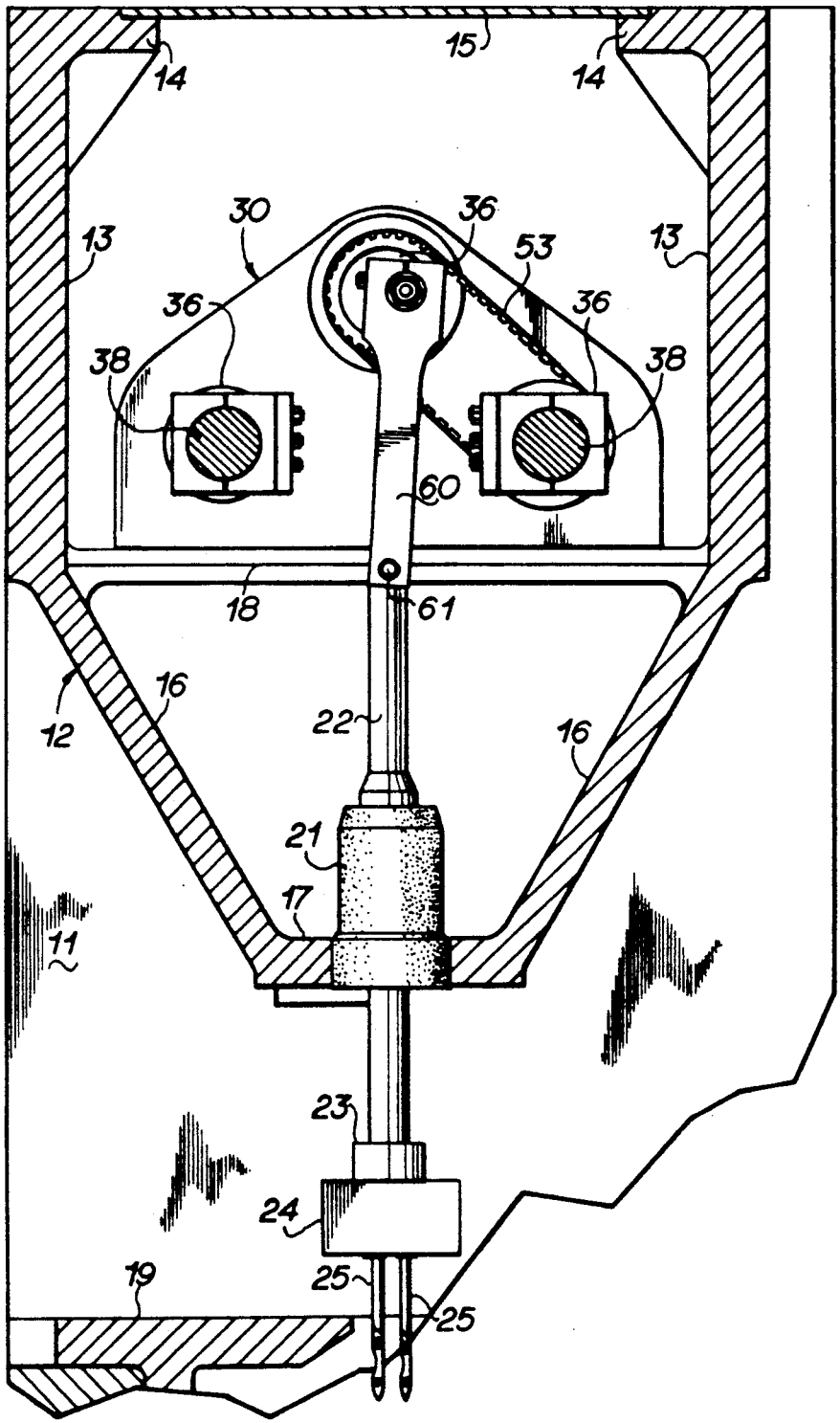
FIG. 1 is a vertical sectional view of the upper portion of the tufting machine constructed in accordance with the present invention.

Referring now in detail to the embodiment chosen for the purpose of illustrating the present invention, numeral 10 denotes generally a tufting machine having a conventional frame 11 with a base or bed plate 19 which extends transversely across the machine. The tufting machine 10 also includes a head 12 which also extends transversely across the machine above the bed plate 19. The head 12 has a pair of opposed vertically disposed spaced parallel sides 13 having upper flanges 14 which support a cover plate 15. A pair of downwardly converging lower side plates 16 support by their lower edges a horizontally extending bottom plate 17. Spaced above and parallel to the bottom plate 17 are a plurality of transversely spaced longitudinally extending mounting platforms 18 which extend from the bottom portion of one of the side plates 13 to the bottom portion of the other side plate 13.

Centrally aligned and transversely spaced from each other are a plurality of pull rod journal members or bushings, such as journal member 21, which protrude through bottom plate 17. These journal members 21 respectively slidably retain the equally transversely, spaced, parallel push rods, such as push rod 22 and 22*a*. Usually there are about nine of these push rods 22 in a four meter tufting machine. The lower end portions of these push rods 22 terminate below the bottom plate 17 and carry support blocks, such as support block 23 which, in turn, support a transversely extending needle bar 24. Needles 25 protrude downwardly from the needle bar 24, forming one or more transverse rows of parallel needles 25, these rows extending across the tufting machine 10. These needles 25 are reciprocated by the needle bar 24 upon simultaneous reciprocation of push rods 22 in vertical path for tufting action by needles 25 in inserting yarns (not shown) through the backing material (not shown).

It will be understood by those skilled in the art that there are loopers (not shown) disposed below the bed plate 19 for engaging and holding the yarns inserted through the backing material (not shown), each time the needles 25 penetrate the backing material. These loopers are at a fixed height to protrude through the loops sewn by the needles, when the needles 25 are at approximately bottom dead center and catch and temporarily hold the loops of yarns.

The structure and functions described above are conventional and therefore a more detailed disclosure of the same is not deemed necessary.

Figure 2:
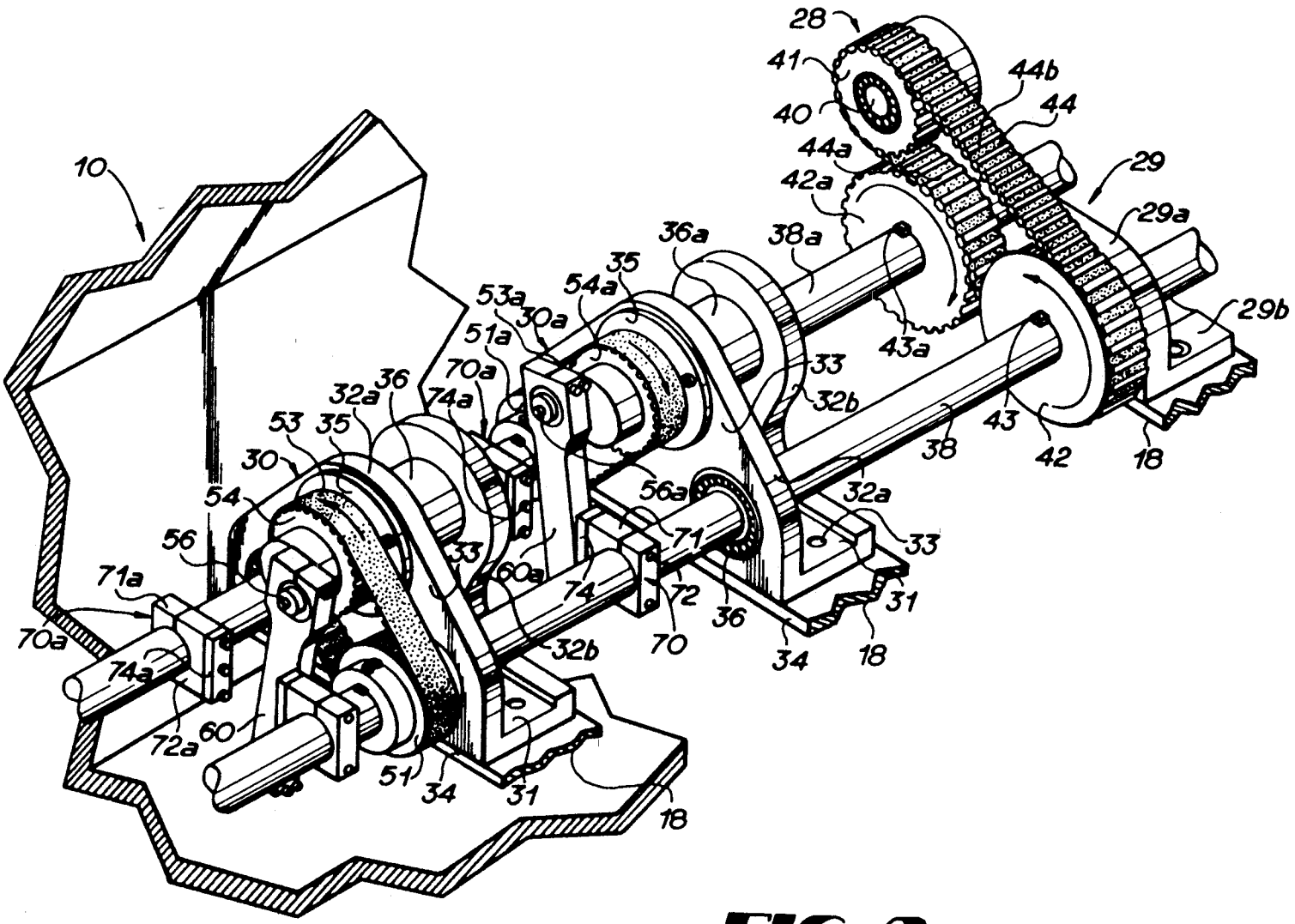
FIG. 2 is a fragmentary prospective view of a portion of the tufting machine depicted in FIG. 1.
Figure 3:
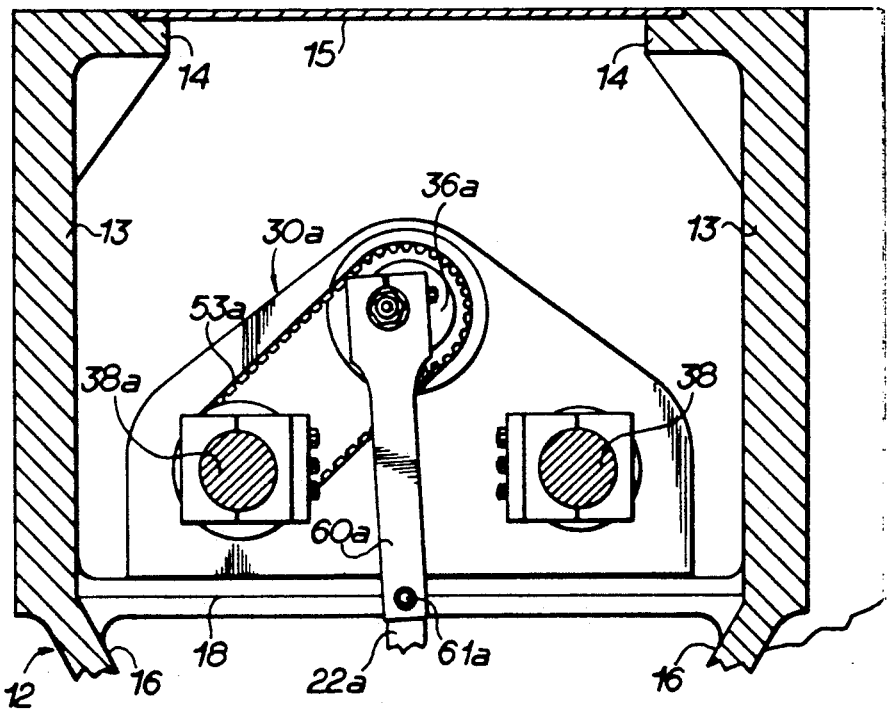
FIG. 3 is a vertical-sectional view similar to FIG. 1 but showing a different needle stroke assembly of the tufting machine of the present invention.

Respectively mounted on the transversely spaced mounting platforms 18 are a plurality of needle stroke assemblies or modules which include individual shaft supporting members, such as shaft support members 29, 30, and 30a. The shaft supporting members 30 and 30a are identical to each other and are aligned in spaced transverse relationship in head 12, the members 30 and 30a being respectively above and slightly offset from the upper ends of the individual push rods 22. Each shaft supporting member 30 or 30a has a rectangular base 31 secured by bolts (not shown) on one of the mounting platforms 18. Pairs of spaced upstanding, parallel, longitudinally extending bearing supporting plates 32a and 32b extend from the sides of each base 31. Each main bearing supporting plate 32a has a flat outer surface 33 which is in a common vertical plane with the outer side 34 of a platform 18. The auxiliary bearing supporting plate 32b is disposed parallel to the main bearing supporting plate 32a, as seen in FIG. 2. The bearing supporting plate 32a is generally triangular in shape and symmetrical, and support an upper central bearing 35. The rear or auxiliary bearing supporting plate 32b is an upstanding member which is parallel to the main bearing supporting plate 32a and includes a bearing (not shown) which is in longitudinal alignment with the bearing 35.

The main bearing supporting plates 30 and 30a are also provided with drive shaft bearings, such as bearing 36 disposed in transverse alignment with each other so that they receive and journal for rotation the two side-by-side spaced, parallel main drive shaft 38 and auxiliary drive shaft 38a. The main drive shaft 38 is driven in a counterclockwise direction as viewed in FIG. 2 by the main motor (not shown) of the tufting machine 10 and the auxiliary drive shaft 38a in a clockwise direction. The axes of the main drive shaft 38 and the auxiliary drive shaft 38a are disposed in a common horizontal plane in the head 12.

Adjacent to the opposite ends of the head 12 are gear drive assemblies, such as assembly 28, which are mounted on platforms, such as a platform 18. The assembly 28 include upstanding shaft support members, such as member 29, which are provided with main bearings, such as bearing 36, so as to journal the end portions of both shafts 38 and 38a, as they protrude through the upright journal plate 29a of each shaft supporting members 29. The upright bearing plate 29a is integrally joined along one edge of a horizontal base 29b which, in turn, is bolted to its appropriate mounting platform 18. Carried by each plate, such as plate 29a, is an inwardly protruding stub shaft 40 which rotatably supports an idler sheave or sprocket or gear 41. Below the sprocket or gear 41, the drive shafts 38 and 38a are respectively provided with opposed sheaves, sprockets or gears 42 and 42a respectively, these gears 42, 42a, being keyed, by keys 43 and 43a, to the shafts 38 and 38a, respectively. A continuous, doublesided, timing belt 44 extends around the gears 41 and 42 and, thence, over a peripheral portion of the gear 42a of shaft 38a. The inner teeth 44a are on the inside of belt 44 and mesh with the teeth of gears 41 and 42 while the outer teeth 44b of belt 44 mesh with the teeth of gear 42a. Through such an arrangement, there is provided a synchronizing means so that when the shaft 38 is rotated in a counterclockwise direction as viewed in FIG. 2, the shaft 38a will be rotated by the gear 42a in a clockwise direction in synchronization and at the same rotational speed as shaft 38. It will be understood that one or several such belt driven gear assemblies, such as gear assembly 28, can be arranged along the length of the shafts 38, 38a, where desired, so as to distribute the torque of the shafts 38 and 38a uniformly throughout the length of these shafts 38 and 38a.

As illustrated in FIG. 2, the shafts 38 and 38a pass through successive bearings, such as bearing 36 in support members 32a and 32b of successive needle drive assemblies or modules, such as needle drive module 30. At each needle drive module 30, the main drive shaft 38 is provided with a drive gear or sprocket 51 around which passes a timing belt 53, the timing belt having internal teeth which mesh with the gear 51. This timing belt 53 then passes around a driven gear 54 mounted on the rotatable stroke or crank shaft 36, which is journaled by the bearings of the bearing supporting plates 32a and 32b. Thus, each shaft 36 is synchronizely rotated or actuated by power from the main drive shaft 38.

The needle drive modules, such as module 30a, are identical to needle drive module 30 except that the shaft 36 thereof is driven from shaft 38a by a timing belt 53a from a drive gear 51a mounted on shaft 38a via driven gear 54a.

Eccentrically mounted respectively on the outer end of crank shafts 36 and 36a, are outwardly protruding crank pins or shafts 56 and 56a. These eccentrically mounted crank pins 56, 56a pass through needle bearings (not shown) on the upper end portions of the connecting rods or elements 60, 60a. The timing is arranged so that all crank pins 56, 56a are at top dead center at the same time and at bottom dead center at the same time.

Pivotably connected to the lower ends of the connecting rods 60 and 60a are the upper end portions of push rods 22 and 22a, respectively. These push rods 22, 22a, as taught in U.S. Pat. No. 4,665,845 can be replaced, as desired so as to position the needle bar 24 at prescribed locations with respect to the backing material, so as to vary the depth of penetration of the needles 25 into the backing material (not shown) without varying the height of the bed plate 19. Pivot pins such as pin 61 connect the connecting rods 60 and 60a to the push rods 22 and 22a.

The crank shafts, such as 36, 36a, are of equal weight and weight distribution, arranged alternately in succession and in transverse concentric alignment with each other, with their common axes disposed along the vertical centerline of head 12. Shafts 36, 36a are preferably equally spaced from each other and with one end of shaft 36 adjacent to and spaced from one end of shaft 36a with the common axes of the shafts 36, 36a in the plane of the axes of the push rods 22. The common axis of shafts 36, 36a is, therefore, parallel to the axes of shafts 38, 38a. Hence, all odd shafts, such as shaft 36, are rotated by power from shaft 38a in a counterclockwise direction, as viewed in FIG. 2, and all even shafts, such as shaft 36a, are rotated a clockwise direction by power from shaft 38. Hence, the pins, such as pin 56, move in aligned orbital paths, counterclockwise, while all pins, such as pin 56a, simultaneously move in aligned orbital paths, clockwise. This enables the upper ends of all odd connecting rods, such as rod 60, to move initially transversely away from the vertical centerline in one lateral direction as the upper portion of all connecting rods, such as rod 60*a*, are initially moved by equal amounts away from the centerline in the opposite direction. Thereafter, the upper end portions of connecting rods 60, 60*a* move toward the centerline until a bottom dead center all connecting rods are aligned along the centerline. From 180° to top dead center is 360°, the upper end portions of connecting rods again move outwardly and then inwardly so as to balance the dynamic accelerations and decelerations of the connecting rods.

It is important that the timing of the stroke of all alternately arranged connecting rods, such as rods 60 and 60*a*, be 180° out of phase with each other so that the pins, such as pins 56 and 56*a*, are at top dead center, simultaneously and are at bottom dead center simultaneously but are alternately rotating in opposite directions.

The counter-rotating shafts 38 and 38*a* thus rotate the shafts 36, 36*a* in counter-rotating directions so that the eccentric crank pins 56 and 56*a* enable the upper portion of the connecting rods 60, 60*a* to counter-balance each other during the movement of the needle bar 24 in an upward direction and in a downward direction.

To further provide for dynamic balancing, the shafts 38 and 38*a* are provided with counter-balance weights 70 and 70*a*, which rotate with the shafts. These counter-balance weights 70, 70*a* form balance items which are used to cancel generally the vertical forces that are created by the reciprocal motion of the needle bar 24. These counter-balance weights include one or more pairs of opposed, rectangular clamp blocks 71, 71*a*, 72 and 72*a* which have concaved inner surfaces which grip from opposite sides, the shafts 38 and 38*a*. Bolts, such as bolt 72, clamp these members 71, 71*a* and 72, 72*a* together so as to circumscribe and clamp the shaft 38 or 38*a*, as the case may be. The outer surface of the clamp blocks 72 and 72*a* are flat and receive, bolted thereon, appropriate size offset weights, such as weights 74, 74*a*. Preferably the counter-balanced weights 70, 70*a* are disposed closely adjacent to the connecting rods 60, 60*a*, respectively. Usually it is desireable to have the weights 74, 74*a* arranged in about 180° outer phase relationship to each other and 180° out of phase with the pins 56, 56*a* so that all weights 74, 74*a* are inwardly adjacent to each other, when the pins 56, 56*a* are 90° along their respective travel in the downward stroke and for the weights 74, 74*a* to be outwardly of each other when the pivot pins 56, 56*a* are at 270° of their stroke and are moving upwardly in their orbital paths.

By such an arrangement, the tufting machine 10 of the present invention is quite well-balanced, to the extent that it can operate at speeds of 2,000 rpm or greater.

The machine of the present invention, therefore, has little vibration which is transmitted to the floor on which the machine 10 is mounted and transmitted little vibration to any yarn feed mechanism which might be associated with the machine. Furthermore, the noise of the machine is reduced so that the affect on the environment, when the machine 10 is running, is not as great as with the prior art machines.

It will obvious skilled in the art that many variations may be made in the embodiment here chosen for the purpose of illustrating the preferred embodiment of the present invention, without departing from scope thereof as defined by the appended claims.

We claim:

1. A tufting machine of the type having:

(a) a frame having a head;

(b) a plurality of spaced parallel push rods carried by said head for simultaneous reciprocation along their respective axes;

(c) a needle bar carried by said push rods and adapted to hold a plurality of needles containing yarns for tufting action upon each reciprocation of said needle bar by said push rods;

(d) a drive shaft for imparting reciprocation to said push rods;

wherein the improvement comprises:

(e) first drive means connected between said drive shaft and a first group of said push rods and moveable in first prescribed paths for imparting reciprocation to said first group of push rods;

(f) second drive means connected between said drive shaft and a second group of said push rods and moveable in second prescribed paths for imparting reciprocal movement to said second group of push rods, the paths of movement of portions of said first drive means and the paths of movement of said second drive means providing counterbalancing effects with respect to each other; and (g) synchronizing means for synchronizing the movement of said first drive means and said second drive means so as to produce said counterbalancing effects resulting from their separate paths of movement.

2. The tufting machine defined in claim 1 wherein said connecting rods respectively have first end portions and second end portions and wherein said first drive means include a plurality of first connecting rods pivotly connected by their first end portions respectively to said first group of push rods and said second drive means include a plurality of second connecting rods connected by their first end portions respectively to said second group of push rods and means for imparting orbital movement to the second end portions of said first group of push rods, in one direction of orbital rotation, and means for imparting orbital movement of the second end portions of said second group of push rods in a direction opposite to the direction of rotation of the first end portions of said first group of push rods.

3. The tufting machine defined in claim 1 wherein said first drive means is rotated in one direction and said second drive means is rotated in the direction opposite to the direction of rotation of said first drive means.

4. The tufting machine defined in claim 1 wherein said first group of push rods are interspersed with said second group of push rods.

5. The tufting machine defined in claim 4 wherein said first group of push rods are alternately arranged with said second group of push rods and wherein said first drive means are respectively arranged above said first group of push rods and said second drive means are respectively arranged above said second group of push rods.

6. The tufting machine defined in claim 1 wherein said synchronizing means includes a pair of drive shafts received in said head in parallel relationship to each other, and means for rotating one of said drive shafts in one direction and the other of said drive shafts in the other direction of rotation, said first drive means and said second drive means including elements which move in orbital paths and are of equal weight.

7. The tufting machine defined in claim 1 wherein said first drive means and said second drive means include a pair of drive shafts and a timing belt extending between said drive shafts, said timing belt imparting synchronized rotation in opposite directions to said drive shafts.

8. A tufting machine comprising:

(a) a frame having a head;

(b) first and second drive shafts disposed within said head;

(c) timing means for simultaneously and synchronously rotating said drive shafts in opposite directions of rotation;

(d) a plurality of spaced parallel push rods protruding through said head, said push rods each having inner and outer end portions;

(e) a needle bar carried by said outer end portions of said push rods, said push rods being simultaneously moveable along their respective axes for reciprocating said needle bar towards and away from said head, said needle bar being adapted to carry needles containing yarns for tufting action when said needle bar is reciprocated;

(f) connecting rods each having opposed first and second end portions, said first end portions of said connecting rods being respectively pivotally connected to the inner end portions of said push rods;

(g) first actuating means actuated by said first drive shaft and respectively connected to the second end portions of certain of said connecting rods for simultaneously moving said second end portions of said certain of said connecting rods in orbital paths in one direction of rotation; and (h) second actuating means actuated by said second drive shaft and respectively connected to the second end portions of the other of said connecting rods for moving the second end portions of the other of said connecting rods in orbital paths in a direction of rotation opposite to the direction of rotation of said certain of said connecting rods.

9. The tufting machine defined in claim 8 wherein said timing means includes a pair of gears fixed respectively on said drive shafts and a timing belt extending between said gears.

10. The tufting machine defined in claim 9 include an idler gear, said timing belt being provided with teeth which mesh with said idler gear and one of the gears on one of said drive shafts, and teeth on the outside of said belt for meshing with the gear on the other of said shafts.

11. The tufting machine defined in claim 8 including wherein said first actuating means and second actuating means include belts and a plurality of spaced aligned stub shafts, certain of which are driven from one drive shaft crank means and certain of which are driven from the other drive shaft, and on the end of said shafts connected respectively to said connecting rods.

12. The tufting machine defined in claim 8 including eccentrically mounted counterbalance weights on said drive shafts.

13. The tufting machine defined in claim 12 wherein said weights are a pair of weights respectively on said shafts and opposed to each other along the lengths of said shafts.

14. The tufting machine defined in claim 13 wherein said weights are approximately 180° out of phase with each other.

15. A tufting machine comprising:

(a) a frame;

(b) a pair of drive shafts supported by said frame;

(c) a plurality of push rods slideably supported by said frame;

(d) a needle bar carried for reciprocation by said push rods;

(e) connecting rods respectively connected to said push rods;

(f) a plurality of odd and even crank assemblies carried by said frame and respectively connected to said connecting rods;

(g) first power transfer means connected to one of said drive shafts for providing power to the odd ones of said cranks assemblies;

(h) second power transfer means connected to the other of said drive shafts for transferring power from said other of said drive shafts to the even ones of said crank assemblies; and (i) means for synchronously rotating said drive shafts in opposite directions.

16. A tufting machine defined in claim 15 wherein said first power transfer means and said second power transfer means include a plurality of timing belts and plurality of gears connected to the shafts and to said crank assemblies for synchronously operating all of said crank assemblies.

17. The tufting machine defined in claim 16 wherein said belts include timing belts having internal teeth and including gears on said drive shafts and on said crank assemblies for meshing with the teeth of said belts.

18. The tufting machine defined in claim 17 wherein said drive shafts are parallel to each other and wherein said frame is provided with a plurality of transversely spaced platforms disposed beneath said drive shafts, and wherein said crank assemblies include upstanding plates carried by said platforms and individual shafts rotatably carried by said plates and disposed in alignment parallel to said drive shafts, said gears for said crank assemblies being mounted for rotating said individual shafts and crank pins on the ends of said individual shafts and engaging portions of said connecting rods in orbital paths.

19. The tufting machine defined in claim 15 wherein said means for rotating said drive shafts in opposite directions includes a pair of gears respectively mounted on said shafts, an idler gear supported in spaced relationship to said shafts and a timing belt, having internal teeth and external teeth, and passing around one of said gears on said main drive shafts and over the other of said gears and around said idler gear.

20. The tufting machine defined in claim 15 including counterbalance weights on said drive shafts, said counterbalance weights being disposed approximately 180° out of phase with each other.

21. A method of counterbalancing a tufting machine of the type having connecting rods with first and second end portions, the first end portions of which connect to push rods which support and reciprocate a needle bar, and the second end portions of which are manipulated for reciprocating the push rods to reciprocate the needle bar carrying needles for tufting action when the needle bar is reciprocated, the steps comprising:

(a) rotating the second end portions of certain of said connecting rods in orbital paths in one direction of rotation about an axis;

(b) rotating the second end portions of the remaining connecting rods in orbital paths about said axis in the other direction of rotation; and (c) synchronizing the rotation of all said second end portions so that the second end portions of all said connecting rods are at top dead center simultaneously and again at bottom simultaneously.

22. The method defined in claim 21 wherein the second end portions of alternate ones of said connecting rods are simultaneously rotated in orbital paths in one direction of rotation about said axis as the second end portions of other of said connecting rods are rotated in orbital paths about said axis an opposite direction of rotation.

23. The process defined in claim 22 providing said orbital paths with axes of rotation and aligning said axes of rotation along a common axis.

* * * * *